United States Patent [19]

Shelby et al.

[11] Patent Number: 4,602,236

[45] Date of Patent: Jul. 22, 1986

[54] LAMINATED BALLAST CORE

[75] Inventors: Billy L. Shelby; James R. Wirt, both of Memphis, Tenn.

[73] Assignee: FL Industries, Inc., Livingston, N.J.

[21] Appl. No.: 699,725

[22] Filed: Feb. 8, 1985

[51] Int. Cl.[4] ..... H01F 27/24

[52] U.S. Cl. ..... 336/216; 336/234

[58] Field of Search ..... 336/210, 216, 234; 428/594, 596, 928, 638, 635, 637

[56] References Cited

U.S. PATENT DOCUMENTS

| | | | |
|---|---|---|---|
| 1,505,085 | 8/1924 | Brigham | 336/210 |
| 1,512,032 | 10/1924 | Ledwinka | 336/210 |
| 1,623,143 | 4/1927 | Warren | 336/210 |
| 1,805,534 | 5/1931 | Troy | 336/216 |
| 2,452,060 | 10/1948 | Klemperer | 336/210 |
| 2,562,693 | 7/1951 | Brooks | 336/210 |
| 3,587,020 | 6/1971 | Waasner | 336/216 |

FOREIGN PATENT DOCUMENTS

| | | | |
|---|---|---|---|
| 502329 | 5/1954 | Canada | 336/210 |
| 2926291 | 1/1981 | Fed. Rep. of Germany | 336/234 |
| 182520 | 2/1963 | Sweden | 336/216 |

*Primary Examiner*—Melvyn J. Andrews
*Assistant Examiner*—John J. Zimmerman
*Attorney, Agent, or Firm*—Laff, Whitesel, Conte & Saret

[57] ABSTRACT

A laminated ballast core is provided comprising a plurality of nearly identically shaped lamination pieces. Each lamination piece is of a general L-shape and has a notch at the upper outside corner of the base section and a tab extending from the upper outside corner of the shorter side section. About one-half of the lamination pieces are aligned adjacent each other to form an upper lamination section. The other half of the lamination pieces are aligned adjacent each other to form a lower lamination section. The upper lamination section is placed on the lower lamination section such that the tabs and corresponding notches are in contact. The height of the tabs and depth of the notches are proportioned such that a gap of preselected width extends between the edge of the upper portion of the side sections and the adjacent portion of the base section.

11 Claims, 10 Drawing Figures

LAMINATED BALLAST CORE

BACKGROUND OF THE INVENTION

The present invention relates to laminated ballast cores and, more particularly, to a laminated ballast core having two multiple piece, generally L-shaped sections joined to form the core.

Transformers perform numerous electrical functions. When connected as a series choke coil in a lighting circuit, the transformer functions as a ballast to limit the current to which the lamp may be exposed. Industry specifications require that the ballast limit current in the lamp circuit such that if a voltage swing of plus or minus five percent of normal line voltage occurs, the wattage to which the lamp will be exposed is limited to plus or minus twelve percent of rated wattage.

Because of the high production volume of lighting fixtures, it is desirable to cut production costs as much as possible while also producing an electrically efficient light fixture. The ballast is an element in such fixtures so it is equally desirable to produce a low cost and efficient ballast. The most widely accepted design of such ballasts has been an "E I" construction. In such a laminated ballast core arrangement, two generally E shaped lamination sections are punched from a rectangular plate of lamination material, usually cold rolled or transformer silicon steel. The E shaped sections are punched side to side, thereby producing two "I" shaped or finger like sections between the legs of the E shaped sections. A selected portion of the middle leg is removed to form a gap between the E sections aligned adjacent to each other with the I sections aligned and welded as a unit to the top and bottom legs of the E sections. A dual spacing is provided in the assembled core where the I sections were punched from the E sections. More efficient use of the laminate material and better and more consistent electrical characteristics of the laminated cores are desired over this known core configuration.

Accordingly, it is an object of the present invention to provide an improved laminated ballast core construction.

SUMMARY OF THE INVENTION

The present invention provides an improved laminated ballast core. The general configuration of the core is an "LL" construction wherein two L-shaped sections are each comprised of a plurality of nearly identical L-shaped lamination pieces. The L shaped pieces are punched from a rectangular plate of laminate material. A plurality of such pieces are aligned adjacent to each other to form a top lamination section and an equal number of such pieces are aligned adjacent to each other to form a bottom lamination section. The top lamination section, which has an L-shaped cross section due to its comprising a plurality of such L-shaped pieces, is placed on top of the bottom lamination section, which also has an L-shaped cross section due to its comprising a plurality of such L-shaped pieces. The positioning of these sections is such that the side or shorter sections of each of the L-shaped sections are adjacent a portion of the base or longer section of the other of the L-shaped sections in an "LL" relation wherein the top L is inverted and has its shorter side section facing the bottom L. This results in the formation of a three dimensional, rectangular box-shaped structure.

Each lamination piece and, accordingly, the cross section of each of the top and bottom lamination sections, is of a general L-shape. A base, generally rectangular section extends lengthwise and a generally rectangular side section extends upwardly from one end of the base section to form the shorter side of the L-shape. A notch is provided in the upper outside corner of the base section of such lamination piece. Due to metal punching limitations, welding technology and the allowable load current crest factor of the circuit including the ballast coil, the width of such notch must be greater than about the thickness of the lamination piece. The depth of the notch is a selected value to provide the desired gap between the end of the side section and the adjacent portion of the base section when the top and bottom lamination sections are assembled. A tab is provided extending from the outer top corner of the side section of each lamination piece. Again, the width of such tab must be greater than about the thickness of the lamination piece. The height of the tab is a selected value such that, when the top lamination section is placed on the bottom lamination section and the aligned rows of tabs on each section contact the aligned row of notches on the other section and vice versa, the difference between the greater height of the tabs and depth of the notches will become the gap between the end of the side section and the adjacent portion of the base section. The aligned row of tabs and notches are welded to each other. The height and width of the tabs and also the depth and width of the notches must be selected such that the welding operation does not blow any material out of the welding area between the notch and tab contact area into gap between the end of the side sections and adjacent portion of the base sections of the lamination sections. Of course, the tab can be located on the base section and the notch can be located on the side section in an alternative embodiment of the present invention. However, as a coil could not be fit as closely over the lower base section if the tab protruded from the base section, it is preferred that the tab extend from the shorter side section of the L-shaped piece. Such a preferred arrangement gives better electrical characteristics due to the closer fit of the coil to the base section.

From an electrical point of view, the ideal width for the notches and tabs is zero, thereby producing a complete gap between the upper and lower lamination sections. However, this would be physically impossible as some contact must occur between the upper lamination section and the lower lamination section to allow welding of the two sections to form a structurally sound core. However, the electrical characteristics of such a completely gapped lamination core can be approached with the lamination core of the present invention. If the width of the contact between the upper and lower lamination sections could be reduced to zero, a gap would be produced without any physical contact between the upper lamination section and the lower lamination section. The lamp current crest factor of a circuit employing such a coil connected in series would be 1.414. As the width of the contact area between the upper and lower lamination sections is increased, the current crest factor increases. Depending on the type of lamp, the width of the contact area must be controlled to limit the current crest factor to the capability of the lamp. For example, for a high pressure sodium lamp, the maximum current crest factor is 1.8. As the state of the art for lamination stamping improves and it becomes possible to have tabs and notches of a width less than the thickness of the lamination piece, such tab and notch widths can be utilized within the restraints on welding discussed above.

Other advantages of the L-shaped lamination shape with the notch and tab welding connection include better registration of the transformer stacks in the welding fixture and a better heat sink during welding than known lamination configurations such as the E I configuration described above. Further, the top lamination section or stack is prevented from collapsing on the gap during the welding operation by the secure contact of the row of tabs with the notches. The control of gap width, an absolutely essential criteria to produce uniform electrical characteristics for a line of lamination cores being produced, is extremely consistent in the L-shaped lamination with tab and notch contact of the present invention.

In particular, the present invention provides a lamination core for use in a ballast, said lamination core comprising a plurality of nearly identically shaped lamination pieces, said about one-half of said lamination pieces being stacked adjacent each other to form a generally L-shaped upper lamination section and the other half of said lamination being stacked adjacent each other to form a generally L-shaped lower lamination section, said upper lamination section being placed in contact with and on top of said lower lamination section to form a complete lamination core.

DESCRIPTION OF THE PREFERRED EMBODIMENT

Figure 1:
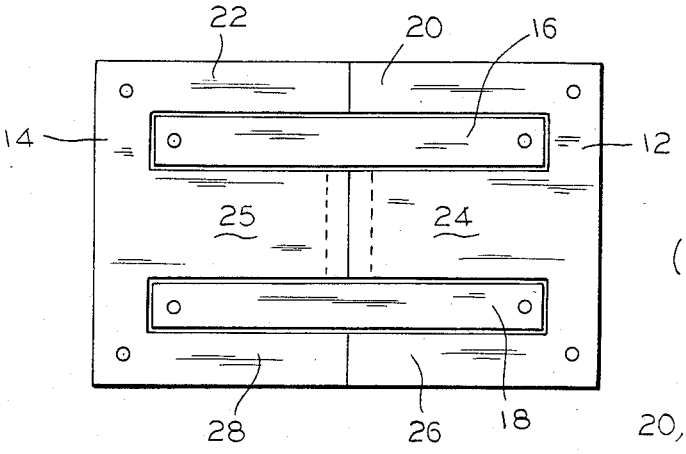
FIG. 1 (PRIOR ART)
FIG. 1 is a top view of a prior art rectangular lamination piece with two E sections and two I sections being punched therefrom.
Figure 2:
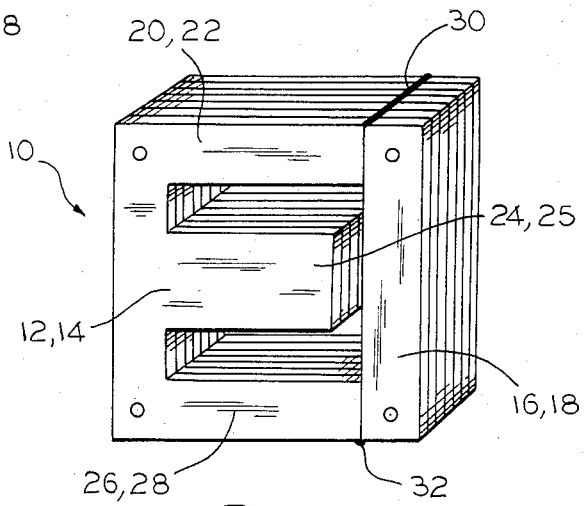
FIG. 2 (PRIOR ART)
FIG. 2 is a perspective view of a prior art E I lamination core utilizing the E and I sections punched in FIG. 1.

Referring now to FIGS. 1 and 2 of the drawings, a prior art laminated core is shown generally at 10. As shown in FIG. 1, a rectangular lamination piece is punched to form E shaped sections 12, 14 and, between fingers such as 20,22, I shaped sections 16,18. A desired amount is removed from the end of the middle finger sections 24,25 to form gap. When all the desired E sections are aligned and an identical number of I sections are aligned, the end fingers 20,22, and 26,28 are butted against the ends of I sections 16,18 and are welded thereto at 30 and 32.

Figure 3:
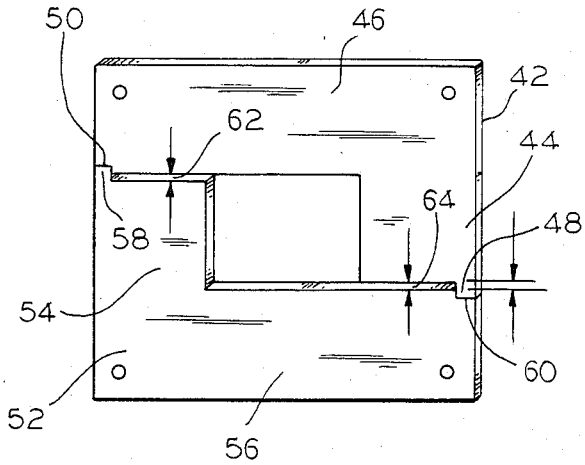
FIG. 3 is a top view of a rectangular lamination piece with two L-shaped lamination pieces being punched therefrom in accordance with the present invention.
Figure 4:
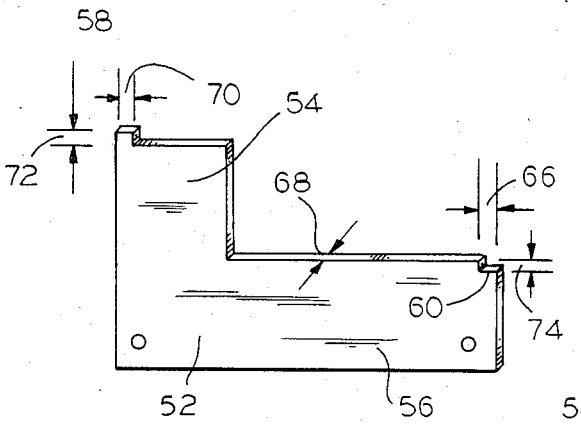
FIG. 4 is a perspective view of an L-shaped lamination piece in accordance with a first embodiment of the present invention.
Figure 5:
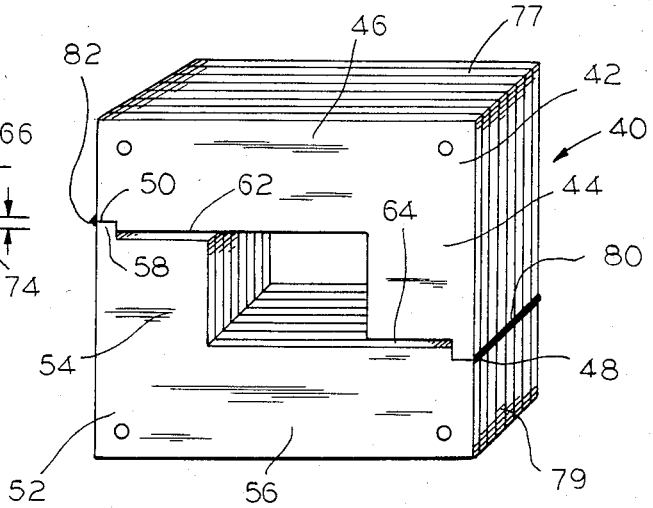
FIG. 5 is a perspective view of an LL lamination core assembled in accordance with the first embodiment of the present invention.

Referring now to FIGS. 3–5 of the drawings, a laminated core in accordance with the present invention, of the so called LL configuration, is shown generally at 40. A top lamination piece 42 and a bottom lamination piece 52 are both punched from a single rectangular piece of cold rolled steel. Lamination piece 42 is of a general L-shape and is comprised of a base section 46 and a shorter side section 44 extending from one end of a base section 46. A notch 50 is present in the corner end of base section 46, and a tab 48 extends from a corner end of side section 44. Another L-shaped lamination piece 52 is simultaneously punched with piece 42 to most efficiently use the material in the rectangular piece of transformer metal. Lamination piece 52 is identical in shape with piece 42, having base section 56 and side section 54 extending therefrom. A notch 60 is present in the corner end of base section 56 and a tab 58 extends from the corner end of side section 54. Sections similar to section 42 are aligned adjacent to each other to form a top laminated section 77 and sections similar to section 52 are aligned adjacent to each other to form bottom laminated section 79, as shown in FIG. 5. Contact between top section 77 and bottom section 79 occurs between the tab sections 48,58 and notched sections 50, 60. The heights of tab sections 48,58 and the depth of notch sections 50,60 are chosen such that the gaps 62,64 are formed to preselected width. Weld 80 is formed between tab 48 and notch 60, and weld 82 is formed between tab 58 and notch 50. These welds 80 and 82 hold the top laminated section 77 to bottom laminated section 79 to form laminated core 40.

Referring particularly to FIG. 4, bottom laminated piece 52 is shown with certain of the desired structural relationships of a laminated piece in accordance with the present invention. The width of laminated piece 52 is shown as 68. The width of notch 60 is shown as 66, and the depth of notch 60 is shown as 74. The height of tab 58 is shown as 72, and the width of tab 58 is shown as 70. The gap width 62 or 64 for the final core 40 will be the tab height 72 minus the notch depth 74. Thus the gap width is readily controllable and adjustable for various designs of cores 40. The width 66 of notch 60 and the width 70 of tab 58 will typically be equal to or slightly greater than the width 68 of laminated piece 52 to assure good welding and structural integrity of core 40. Similar desired dimensions apply to identical top section laminated piece 42.

Figure 8:
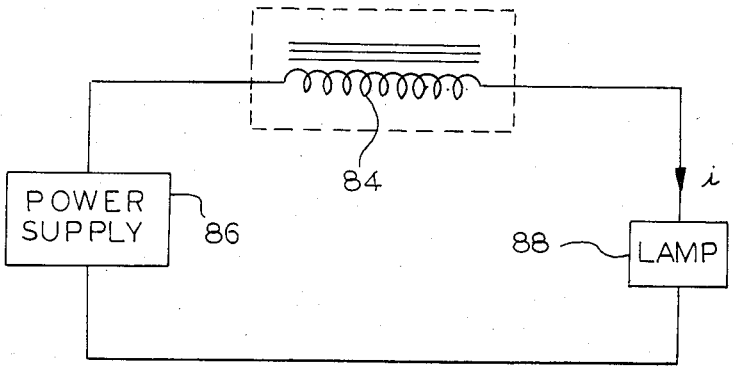
FIG. 8 is a circuit diagram with a lamination core coil in series with a lamp.
Figure 9:
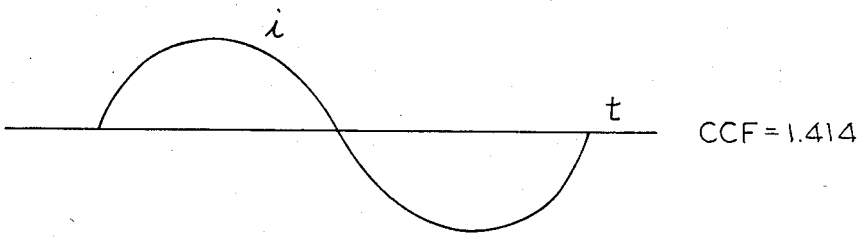
FIG. 9 is a current waveform depicting theoretical minimum current crest factor of about 1.414.
Figure 10:
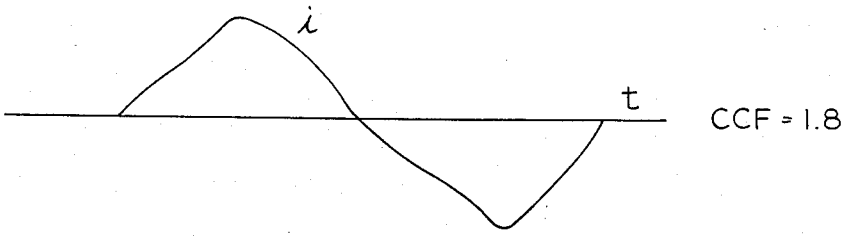
FIG. 10 is a current waveform depicting a current crest factor of about 1.8.

Referring now to FIG. 8, a typical lamp circuit employing a laminated core coil 84 is shown as connected in series between power supply 86 and lamp 88 to limit the peak current to which the lamp can be exposed, depending on voltage variations from power supply 86. Referring to FIG. 9, the best possible theoretical current (and, accordingly, voltage) control for the lamp occurs when current i is passed through a core coil 84 having no physical connection between upper and lower section, i.e., having gaps without any physical connection of laminated sections between such upper and lower sections. The current crest factor of such an arrangement is the square root of 2, or 1.414. With an actually obtainable core coil arrangement with certain physical connection between upper core section 72 and lower core section 79 as shown in FIG. 5, the current crest factor will increase to about 1.8. This current factor is shown in FIG. 10. More peaking of the current is possible, but it is still limited to achieve the acceptable construction of lamp design.

Figure 6:
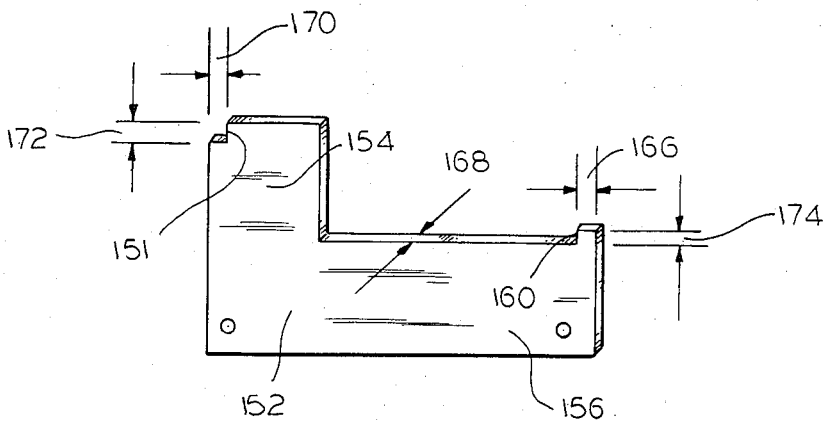
FIG. 6 is a perspective view of an L-shaped lamination piece in accordance with a second embodiment of this invention.
Figure 7:
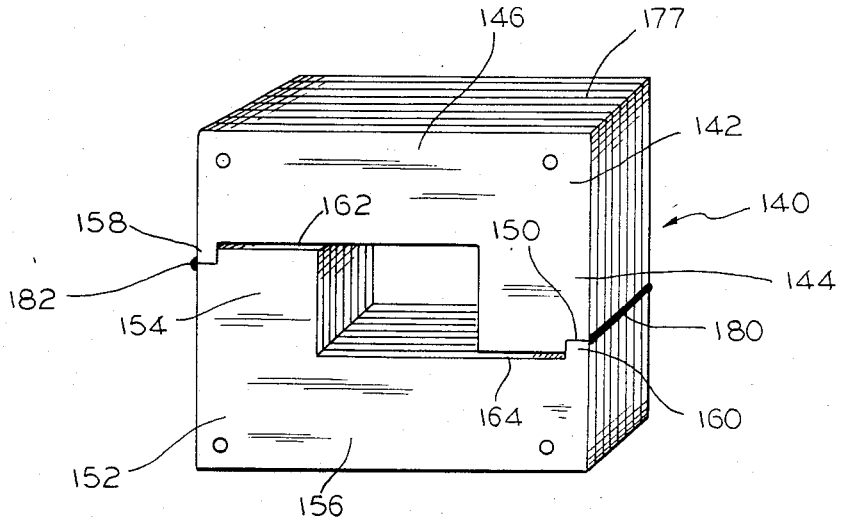
FIG. 7 is a perspective view of an LL lamination core assembled in accordance with the second embodiment of this invention.

Referring now to FIGS. 6–7 of the drawings, a laminated core in accordance with an alternative embodiment of the present invention, of the so called LL configuration, is shown generally at 140. A top lamination piece 142 and a bottom lamination piece 152 are both punched from a single rectangular piece of cold rolled steel. Lamination piece 142 is of a general L-shape and is comprised of a base section 146 and a shorter side section 144 extending from one end of base section 146. A notch 150 is present in the corner end of side section 144, and a tab 158 extends from a corner end of base section 146. Another L-shaped lamination piece 152 is simultaneously punched with piece 142 to most efficiently use the material in the rectangular piece of transformer metal. Lamination piece 152 is identical in shape with piece 142, having base section 156 and side section 154 extending therefrom. A tab 160 extends from the corner end of base section 156 and a notch 151 is present the corner end of side section 154. Sections similar to section 142 are aligned adjacent to each other to form a top laminated section 177 and sections similar to section 152 are aligned adjacent to each other to form bottom laminated section 179, as shown in FIG. 8. Contact between top section 177 and bottom section 179 occurs between the tab sections 158,160 and notch sections 151,150. The heights of tab sections 158,160 and the depth of notch sections 151,150 are chosen such that the gaps 162,164 are formed to preselected width. Weld 180 is formed between tab 160 and notch 150, and weld 182 is formed between tab 158 and notch 151. These welds 180 and 182 hold the top laminated section 177 to bottom laminated section 179 to form laminated core 140.

Referring particularly to FIG. 7, bottom laminated piece 152 is shown with certain of the desired structural relationships of a laminated piece in accordance with the present invention. The width of laminated piece 152 is shown as 168. The width of notch 151 is shown as 170, and the depth of notch 151 is shown as 172. The height of tab 160 is shown as 174, and the width of tab 160 is shown as 166. The gap width 162 or 164 for the final core 140 will be the tab height 174 minus the notch depth 172. Thus the gap width is readily controllable and adjustable for various designs of cores 140. The width 166 of notch 160 and the width 170 of tab 151 will typically be equal to or slightly greater than the width 168 of laminated piece 152 to assure good welding and structural integrity of core 140. Similar desired dimensions apply to identical top section laminated piece 142.

What is claimed is:

1. A lamination core for use in a ballast, said lamination core comprising a plurality of nearly identically shaped lamination pieces, about one-half of said lamination pieces being stacked adjacent each other to form a generally L-shaped upper lamination section and the other half of said lamination being stacked adjacent each other to form a generally L-shaped lower lamination section, said upper lamination section being abuttingly placed in contact with and on top of said lower lamination section to form a complete lamination core;

said lamination core forming a generally rectangular box which has a rectangular opening through the center axis thereof;

each of said sections having a tab at one free end thereof and an indentation at another;

said tab of one section being welded to at least one engaging surface of the indentation of another section and forming a straight gap between adjacent ends of said sections.

2. The lamination core of claim 1 wherein each lamination piece is of a generally L-shaped configuration, and has a tab extending from the shorter side of the L and an indentation on the longer side, said tab engaging said indentation when said upper lamination section is placed in contact with said lower lamination section, said tab and said indentation being proportioned such that a preselected gap is left between the adjacent section of said upper lamination section and said lower lamination section.

3. The lamination core of claim 1 wherein each lamination piece has a generally L-shaped structure, the longer base section of which has a notch cut out from the upper corner of its free end, and the shorter side section of which has a tab projecting from the upper corner of its outer edge, the depth of said notch and the length of said tab being proportioned such that, upon the adjacent alignment of said lamination pieces to form said upper lamination L-shaped section and said lower lamination L-shaped section and the placing of said upper lamination section on top of said lower lamination section in a manner such that the respective notches and tabs of said upper and lower lamination section are in contact with each other, a preselected gap is present between the end edges of the shorter side section of both of the upper and lower lamination sections and the adjacent portion of the longer base sections of the upper and lower lamination sections.

4. The lamination core of claim 3 wherein the width of the tab on each lamination piece is at least the width of each lamination piece.

5. The lamination core of claim 3 wherein the preselected gap is equal to the height of the tab on each lamination piece minus the depth of the notch on each lamination piece.

6. The lamination core of claim 3 wherein the width of the tab on each lamination piece is less than or equal to the width of the notch on each lamination piece.

7. The lamination core of claim 1 wherein each lamination piece is comprised of silicon transformer steel.

8. The lamination core of claim 1 wherein each lamination piece is of a generally L-shaped configuration, and has a tab extending from the larger side of the L and an indentation on the shorter side, said tab engaging said indentation when said upper lamination section is placed in contact with said lower lamination section, said tab and said identation being proportioned such that a preselected gap is left between the adjacent section of said upper lamination section and said lower lamination section.

9. The lamination core of claim 1 wherein each lamination piece has a generally L-shaped structure, the shorter side section of which has a notch cut out from the upper corner of its free end, and the longer base section of which has a tab projecting from the upper corner of its outer edge, the depth of said notch and the length of said tab being proportioned such that, upon the adjacent alignment of said lamination pieces to form said upper lamination and the slacing of said upper lamination section on top of said lower lamination section L-shaped section and said lower lamination L-shaped section in a manner such that the respective notches and tabs of said upper and lower lamination section are in contact with each other, a preselected gap is present between the end edges of the shorter side section of both of the upper and lower lamination sections and the adjacent portion of the longer base sections of the upper and lower lamination sections.

10. The lamination core of claim 1 wherein each lamination piece is comprised of cold rolled steel.

11. A lamination core for use in a ballast, said lamination core comprising a plurality of nearly identically shaped lamination pieces, each said lamination piece comprising a relatively thin, L-shaped piece having a base section and a shorter side section extending at a right angle thereto, a notch formed at an upper outside corner of each lamination piece base section and a tab extending from an upper outside corner of each lamination piece side section, about one-half of said lamination pieces being aligned adjacent each other to form an upper lamination section and the other half of said lamination pieces being aligned adjacent each other to form a lower lamination section, said upper lamination section being placed on top of said lower lamination section such that the tabs contact the corresponding notches along two sides of said lamination section to form a generally rectangular lamination core;

the height of the tabs and the depth of the notches being proportioned in such a way so that a straight gap of a preselected width is formed between the edge of the side sections of both the upper and lower lamination sections and the adjacent portion of the base section of the upper and lower lamination sections;

a rectangular opening formed along the axis of the joined upper and lower lamination sections;

each of said tabs and notches having a substantially rectangular shape and snugly mating with corresponding tabs and notches in the other lamination section.

* * * * *